United States Patent [19]

Harkins

[11] 4,191,317

[45] Mar. 4, 1980

[54] TOILET PAPER UNROLLING FIXTURE

[76] Inventor: Lane J. Harkins, P.O. Box 149, Berthoud, Colo. 80513

[21] Appl. No.: 905,190

[22] Filed: May 12, 1978

[51] Int. Cl.[2] ..... B65H 35/10; A47K 10/22; B26F 3/02

[52] U.S. Cl. ..... 225/77; 225/46; 242/55.53

[58] Field of Search ..... 242/55.53, 55.2; 225/80, 79, 77, 46, 47, 49, 85

[56] References Cited

U.S. PATENT DOCUMENTS

| | | | |
|---|---|---|---|
| 429,029 | 5/1890 | Geltz | 225/85 X |
| 525,335 | 9/1894 | Clarke | 225/80 X |
| 2,331,791 | 10/1943 | Noel | 225/80 |
| 2,737,353 | 3/1956 | Banks, Jr. | 242/55.53 |
| 2,832,549 | 4/1958 | Youngberg | 225/85 X |
| 3,972,458 | 8/1976 | Hamada | 225/85 X |

*Primary Examiner*—George F. Mautz
*Attorney, Agent, or Firm*—William E. Hein

[57] ABSTRACT

A toilet paper unrolling fixture adapted for simple attachment to a conventional toilet paper holder includes a frame, a paper guide over which the free end of a roll of toilet paper passes, and a tear bar for enabling the user to quickly tear a length of paper from the roll.

1 Claim, 4 Drawing Figures

TOILET PAPER UNROLLING FIXTURE

BACKGROUND AND SUMMARY OF THE INVENTION

This invention relates generally to toilet paper holders and more specifically to an attachment therefor for holding the free end of a roll of toilet paper in a position such that ready access thereto is provided the user.

Conventional toilet paper holders that are routinely installed in residential and commercial buildings typically provide no mechanism for giving the user ready access to the free end of a roll of toilet paper held thereby. Rather, the user is required to turn the roll of toilet paper in search of the free end, often times under subdued lighting conditions. Such searching is frequently annoying to the user, particularly when the free end has adhered itself to the remainder of the roll as the result of the previous use of a length of paper from the roll.

In accordance with one of the illustrated preferred embodiments of the present invention, a toilet paper unrolling fixture is provided which may be quickly and simply attached to a conventional recessed toilet paper holder. In accordance with another illustrated preferred embodiment of the invention, the toilet paper unrolling fixture is adapted for attachment to a flush mounted type of toilet paper holder. Each of the illustrated embodiments of the invention includes a frame member, a paper guide over which the free end of a roll of toilet paper passes, and a tear bar for supporting the free end of the roll in a position that enables the user to quickly tear a desired length of paper from the roll.

DESCRIPTION OF THE PREFERRED EMBODIMENTS

Figure 1:
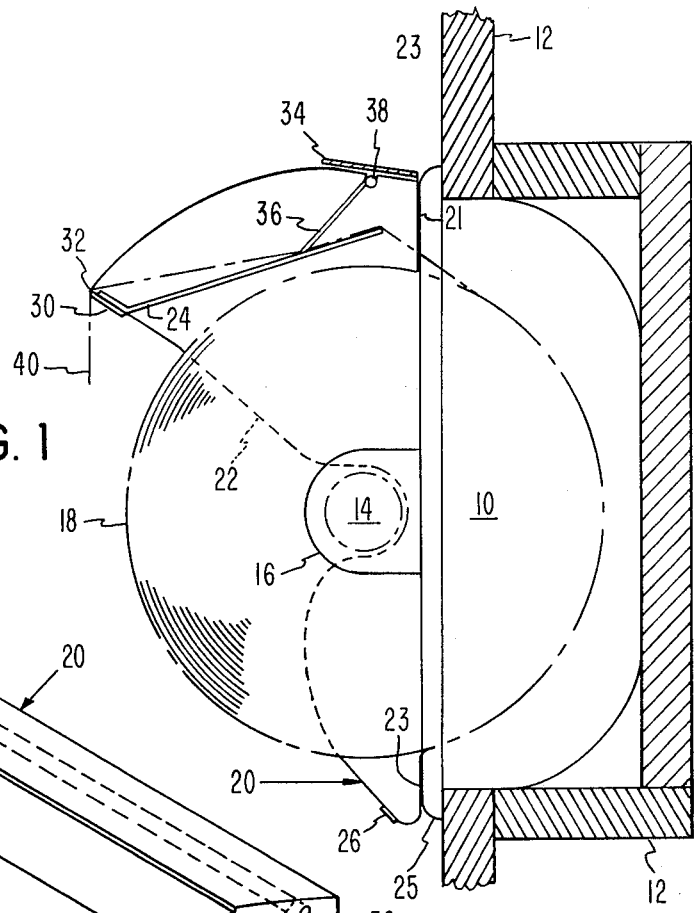
FIG. 1 is a pictorial illustration of the way in which a toilet paper unrolling fixture constructed in accordance with one embodiment of the present invention is positioned within a conventional recessed type of toilet paper holder.
Figure 2:
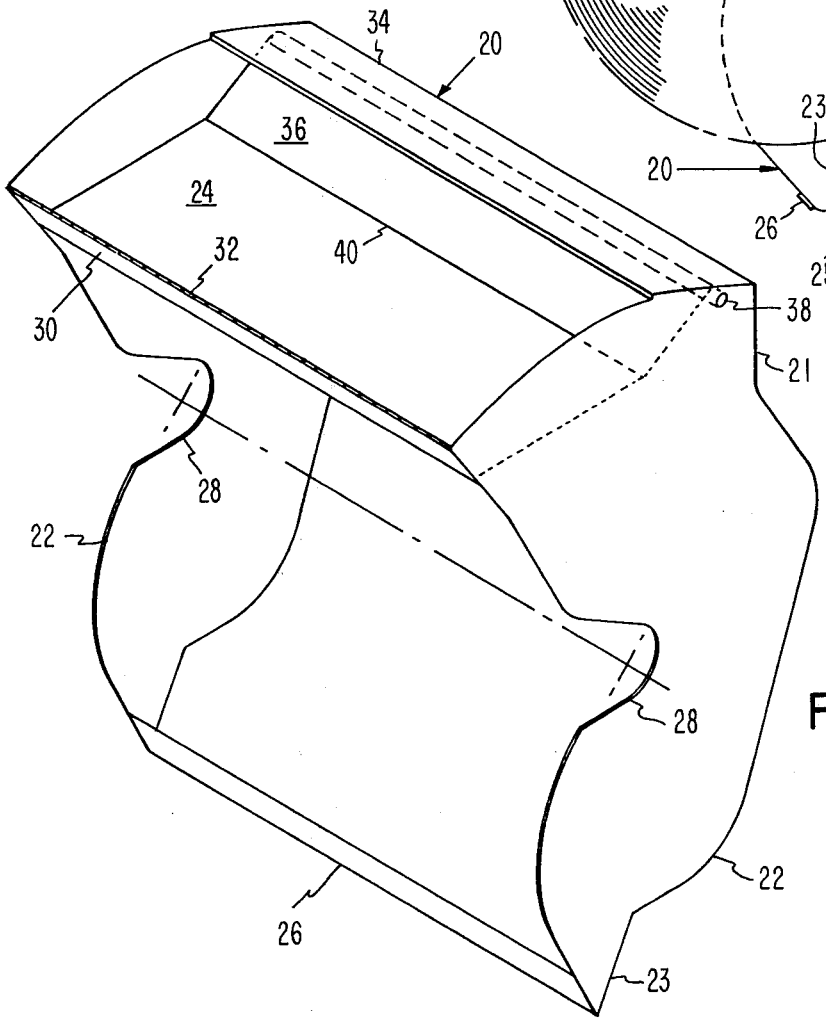
FIG. 2 is a perspective view of the toilet paper unrolling fixture of FIG. 1.

Referring now to FIGS. 1 and 2, there is shown a typical recessed toilet paper holder 10 that is positioned within a recess in wall section 12. Paper holder 10 includes a spindle 14 that extends between a pair of side members 16 to hold a roll of toilet paper 18 in position for the user.

In accordance with one embodiment of the present invention illustrated in FIGS. 1 and 2, a toilet paper unrolling fixture 20 is provided for simple attachment to recessed toilet paper holder 10. Toilet paper unrolling fixture 20 comprises a pair of symmetrical parallel side members 22 that are spaced apart a distance slightly greater than the width of toilet paper roll 18 but slightly less than the distance between side members 16 of recessed paper holder 10. Each one of the side members 22 of the toilet paper unrolling fixture 20 is shaped to include a generally semicircular notch area 28 along the forward edge thereof that is formed to fit behind spindle 14 and thus hold the toilet paper unrolling fixture 20 in place within paper holder 10. The rearward edge of each of the side members 22 includes a vertical top portion 21 that fits flush against an upper lip 23 of paper holder 10 and further includes a vertical bottom portion 23 that fits flush against a bottom lip 25 of paper holder 10 when the unrolling fixture is positioned within the paper holder 10. A generally flat paper guide 24 is fixedly positioned between and near the top of side members 22. The bottom ends of side members 22 are supported by means of a lower support member 26 that extends there between. A tear bar 30 is horizontally positioned between side members 22 adjacent the forward edge of paper guide 24. A top edge of tear bar 30 may, if desired, be slightly serated to aid the user in tearing a length of paper from roll 18. An upper support member 34 extends between side members 22 to provide support for the top, rearward area of side members 22. A horizontally positioned flap 36 is hingedly attached, by means of a pin 38, between side members 22 and adjacent upper support member 34. Flap 36 is positioned such that a forward edge 40 thereof rests on paper guide 24.

The toilet paper unrolling fixture 20 may be fabricated of separate metallic parts that are attached to each other by means of any of a number of commonly used techniques. In the alternative, it may be fabricated of any of plastic like materials using molding technology that is well known and understood by those persons skilled in the art.

In operation, toilet paper unrolling fixture 20 is positioned behind spindle 14 and within recessed paper holder 10, as illustrated in FIG. 1. As further illustrated in FIG. 1, the free end 40 of paper roll 18 is placed on top of paper guide 24, under flap 36, and over tear bar 30. Thus, the free end 40 of paper roll 18 is held away from the bulk of the paper roll to prevent frictional attachment thereto and is in a position of ready accessibility to the user.

Figure 3:
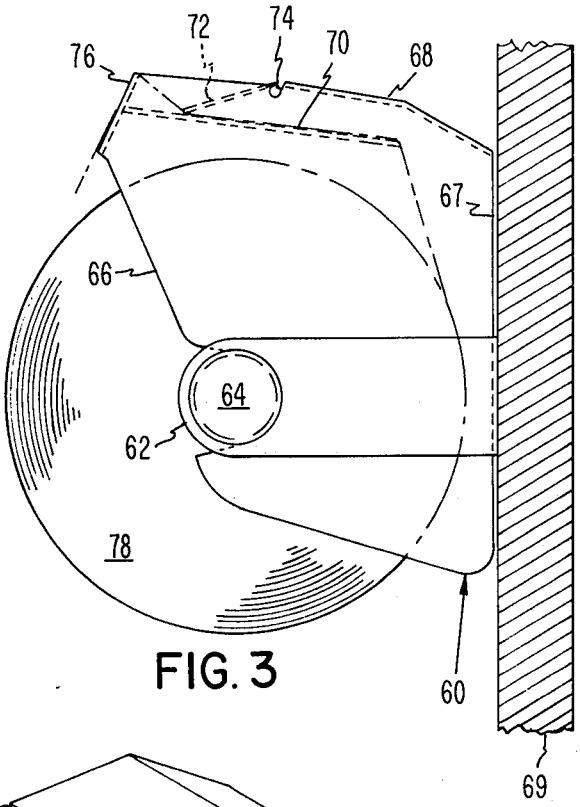
FIG. 3 is a pictorial illustration of the way in which a toilet paper unrolling fixture constructed in accordance with another embodiment of the present invention is positioned within a conventional flush mounted type of toilet paper holder.
Figure 4:
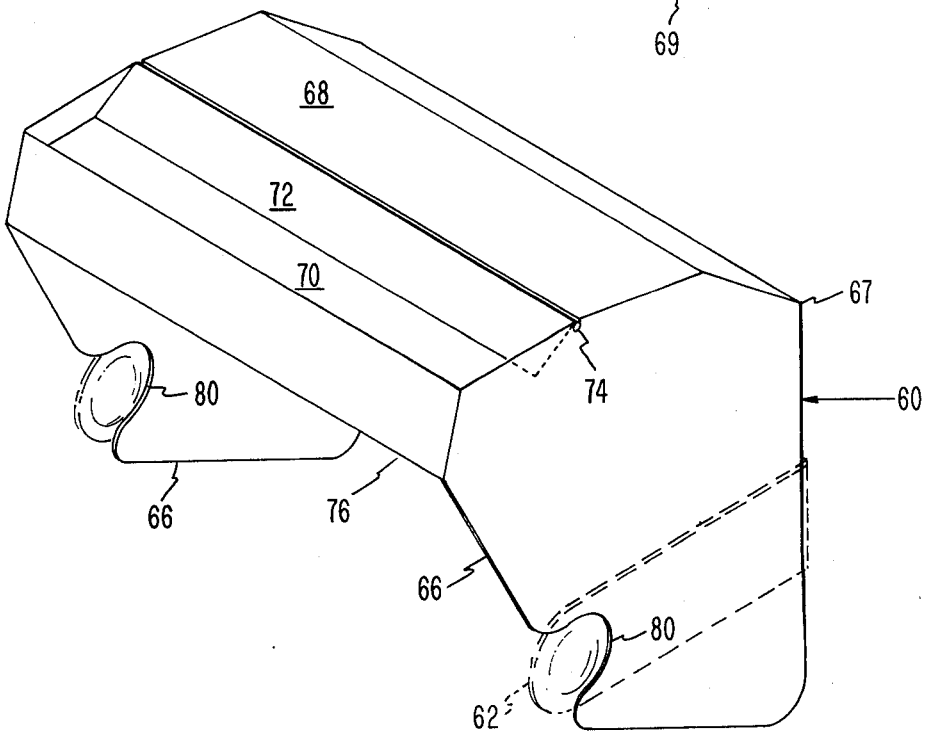
FIG. 4 is a perspective view of the toilet paper unrolling fixture of FIG. 3.

In accordance with another embodiment of the present invention illustrated in FIGS. 3 and 4, a toilet paper unrolling fixture 60 is provided for simple attachment to a conventional flush mounted type of toilet paper holder that includes a pair of side brackets 62 and a spindle 64. Paper unrolling fixture 60 comprises a housing that includes a pair of symmetrical side members 66, a vertical rear member 67, and a top member 68. A paper guide 70 is positioned between side members 66. A flap 72 is hingedly attached by means of pin 74 to rest on paper guide 70 in a manner similar to that in which flap 36 is attached between side members 22 of paper unrolling fixture 20 illustrated in FIGS. 1 and 2. A tear bar 76 is attached between side members 66 just forward of paper guide 70. Side members 66 are spaced a part to fit outside of paper roll 78 within side brackets 66. Side members 66 are each formed to include a generally hemispherical notch area 80 to fit behind spindle 64. Rear member 67 of paper unrolling fixture 60 is arranged to fit flush against a wall 69 when the unrolling fixture is positioned within the paper holder behind spindle 64, as illustrated in FIG. 3. Operation of the toilet paper unrolling fixture 60 is similar to that of unrolling fixture 20 described hereinabove.

I claim:

1. In a conventional built-in recessed toilet paper holder of the type that includes a housing having a pair of spaced apart side brackets between which a spindle is suspended for rotatably supporting a roll of toilet paper for the convenience of the user, the improvement comprising:

a frame having a pair of like vertically positioned side members, each of said pair of side members including a generally semicircular notch area for holding the frame in place behind the spindle, the side members being spaced apart a distance greater than the width of the roll of toilet paper, but less than the distance between the side brackets of the toilet paper holder;

a generally flat paper guide spaced above the roll of toilet paper and fixedly positioned between the side members and over which the free end of the roll of toilet paper extends as paper is reeled off the roll;

a tensioning flap, a first edge of which is spaced above said paper guide and hingedly attached between the side members, said tensioning flap having a second edge that engages the free end of the roll of toilet paper that extends over the paper guide; and a tear bar positioned between the side members proximate to a forward edge of the paper guide for enabling the user to tear a desired length of paper from the free end of the roll of toilet paper.

* * * * *